US007140312B2

(12) United States Patent
Yamada

(10) Patent No.: US 7,140,312 B2
(45) Date of Patent: Nov. 28, 2006

(54) DEVICE, SYSTEM AND METHOD FOR EMBROIDERING AND PRINTING ON FABRIC

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/059,327

(22) Filed: Feb. 17, 2005

(65) Prior Publication Data

US 2005/0178309 A1 Aug. 18, 2005

(30) Foreign Application Priority Data

Feb. 18, 2004 (JP) ..... 2004-040935

(51) Int. Cl.
*D05B 19/00* (2006.01)

(52) U.S. Cl. ..... 112/470.05

(58) Field of Classification Search ..... 112/102.5, 112/103, 119, 475.04, 475.18, 127.1; 347/2
See application file for complete search history.

(56) References Cited

U.S. PATENT DOCUMENTS 5,144,899 A * 9/1992 Allen ..... 112/103
6,532,883 B1 * 3/2003 Omiya et al. ..... 112/454
6,832,569 B1 * 12/2004 Krasnitz ..... 112/475.18

FOREIGN PATENT DOCUMENTS

JP A-05-272046 10/1993

* cited by examiner

*Primary Examiner*—Gary L. Welch
(74) *Attorney, Agent, or Firm*—Oliff & Berridge, PLC

(57) ABSTRACT

There is provided an inkjet printing device for performing a printing operation on fabric by use of an embroidery frame which is also used by a sewing machine to form an embroidery pattern on fabric. The inkjet printing device is provided with an inkjet head that ejects ink on the fabric, a holding member configured to fit in the embroidery frame to hold the embroidery frame, and a print control unit configured to perform the printing operation on the fabric held by the embroidery frame by use of the inkjet head and the holding member. The embroidery frame holds the fabric in a state of tension. The embroidery frame is fitted to the holding member in a condition where the fabric is stretched on one side of the embroidery frame, the one side facing the inkjet head.

15 Claims, 5 Drawing Sheets

DEVICE, SYSTEM AND METHOD FOR EMBROIDERING AND PRINTING ON FABRIC

INCORPORATION BY INVENTION REFERENCE

This application claims priority of Japanese Patent Application No. 2004-040935, filed on Feb. 18, 2004, the entire subject matter of the application is incorporated herein by reference thereto.

BACKGROUND OF THE INVENTION

The present invention relates to an inkjet printing device, a system and method for embroidering and printing on fabric.

In general, a technique in which an operation of printing on fabric is performed after the fabric is subjected to embroidering by a sewing machine has been used. Such a technique allows a vender of the fabric to represent multicolor designs (images or patterns) on the fabric. In such a case, an exact positioning of the fabric is required in each of an embroidering process and a printing process.

Japanese Patent Provisional Publication No. HEI 5-272046 discloses a machine (hereafter, referred to as an embroidering and printing machine) which is capable of performing both of a printing operation and an embroidering operation. According to the publication, embroidery data is transmitted to the embroidering and printing machine from an external computer to perform the embroidering operation while moving an embroidery frame. After the embroidering operation is finished, the embroidery frame is moved to a predetermined position at which an inkjet head is located to perform the printing operation while ejecting ink from the inkjet head based on the embroidery data and moving the embroidery frame.

SUMMARY OF THE INVENTION

The exact positioning of the fabric in each of the printing operation and the embroidering operation is attained by using the conventional device disclosed in the publication. However, it is required to use a dedicated device (i.e. the embroidering and printing machine) to attain the exact positioning of the fabric in each of the printing operation and the embroidering operation.

The present invention is advantageous in that it provides a device, system and method for attaining an exact positioning in each of a printing operation and an embroidering operation without requiring to use a dedicated device.

According to an aspect of the present invention, there is provided an inkjet printing device for performing a printing operation on fabric by use of an embroidery frame which is also used by a sewing machine to form an embroidery pattern on fabric. The inkjet printing device is provided with an inkjet head that ejects ink on the fabric, a holding member configured to fit in the embroidery frame to hold the embroidery frame, and a print control unit configured to perform the printing operation on the fabric held by the embroidery fame by use of the ink et head and the holding member. The embroidery frame holds the fabric in a state of tension. The embroidery frame is fitted to the holding member in a condition where the fabric is stretched on one side of the embroidery frame, the one side facing the inkjet head.

With this configuration, positioning of the fabric for the painting operation is attained by use of the embroidery frame without difficulty. It is prevented that the distance between an inkjet head and a printing surface is lengthened by a height of the embroidery frame, by which high printing quality is maintained.

Optionally, print data used to perform the printing operation on the fabric may be based on coordinates of the embroidery frame.

According to another aspect of the invention, there is provided an embroidering and printing system, which is provided with a sewing machine having an embroidery frame that holds the fabric in a state of tension, and an inkjet printing device having an inkjet head for ejecting ink on fabric. The embroidery frame is configured to be detachably attached to the sewing machine. The inkjet printing device includes a holding member configured to fit in the embroidery frame to hold the embroidery frame, a print control unit configured to perform a printing operation on the fabric by driving the inkjet head. In this structure, the embroidery frame is fitted to the holding member in a condition where the fabric is stretched on one side of the embroidery frame, the one side facing the inkjet head.

With this configuration, positioning of the fabric for both of the embroidering operation and the printing operation is attained by use of the embroidery frame without difficulty. It is prevented that the distance between an inkjet head and a printing surface is lengthened by a height of the embroidery frame, by which high printing quality is maintained.

With regard to the above mentioned two aspects of the invention, the embroidery frame may include an inner frame and an outer frame surrounding the inner frame, the fabric being stretched by being pinched between the inner frame and the outer frame. Optionally, the holding member of the inkjet printing device may include a platen having a projected part to which the embroidery frame is fitted.

Still optionally, the sewing machine may include a tension adjustment unit that adjusts tension of an upper thread and a lower thread, and the tension adjustment unit way operate so that the tension of the upper thread is stronger than that of the lower thread.

Still optionally, print data used to perform the printing operation on the fabric by the inkjet printing device and embroidery data used to perform an embroidery operation by the sewing machine may be based on coordinates of the embroidery frame.

According to another aspect of the invention, there is provided a method of embroidering and printing on fabric, which is provided with embroidering an embroidery pattern on the fabric which is held by an embroidery frame in a state of tension, reversing the embroidery frame holding the fabric to attach the embroidery frame to an inkjet printing device, attaching the embroidery frame to the inkjet printing device so that the fabric is situated on one side of the embroidery frame facing the inkjet head, and printing on the fabric held by the embroidery frame attached to the inkjet printing device.

With this configuration, positioning of the fabric for both of the embroidering operation and the printing operation is attained by use of the embroidery frame without difficulty. It is prevented that the distance between an inkjet head and a printing surface is lengthened by a height of the embroidery frame, by which high printing quality is maintained.

According to another aspect of the invention, there is provided a method of embroidering and printing on fabric, which is provided with printing on the fabric which is held by an embroidery frame in a state of tension, reversing the embroidery frame holding the fabric to attach the embroidery frame to an sewing machine, attaching the embroidery frame to the sewing machine so that the fabric is situated on a bottom side of the embroidery frame, and embroidering an embroidery pattern on the fabric held by the embroidery frame attached to the sewing machine.

With this configuration, positioning of the fabric for both of the embroidering operation and the printing operation is attained by use of the embroidery frame without difficulty. It is prevented that the distance between an inkjet head and a printing surface is lengthened by a height of the embroidery frame, by which high printing quality is maintained.

Optionally, the method may include adjusting tension of an upper thread and a lower thread, before embroidering the embroidery pattern on the fabric, such that the tension of the upper thread is stronger than that of the lower thread.

Still optionally, the method may include replacing the upper thread and the lower thread with each other before embroidering the embroidery pattern on the fabric.

BRIEF DESCRIPTION OF THE ACCOMPANYING DRAWINGS

DETAILED DESCRIPTION OF THE EMBODIMENTS

Hereafter, an embodiment according to the invention will be described with reference to the accompanying drawings.

Figure 1:
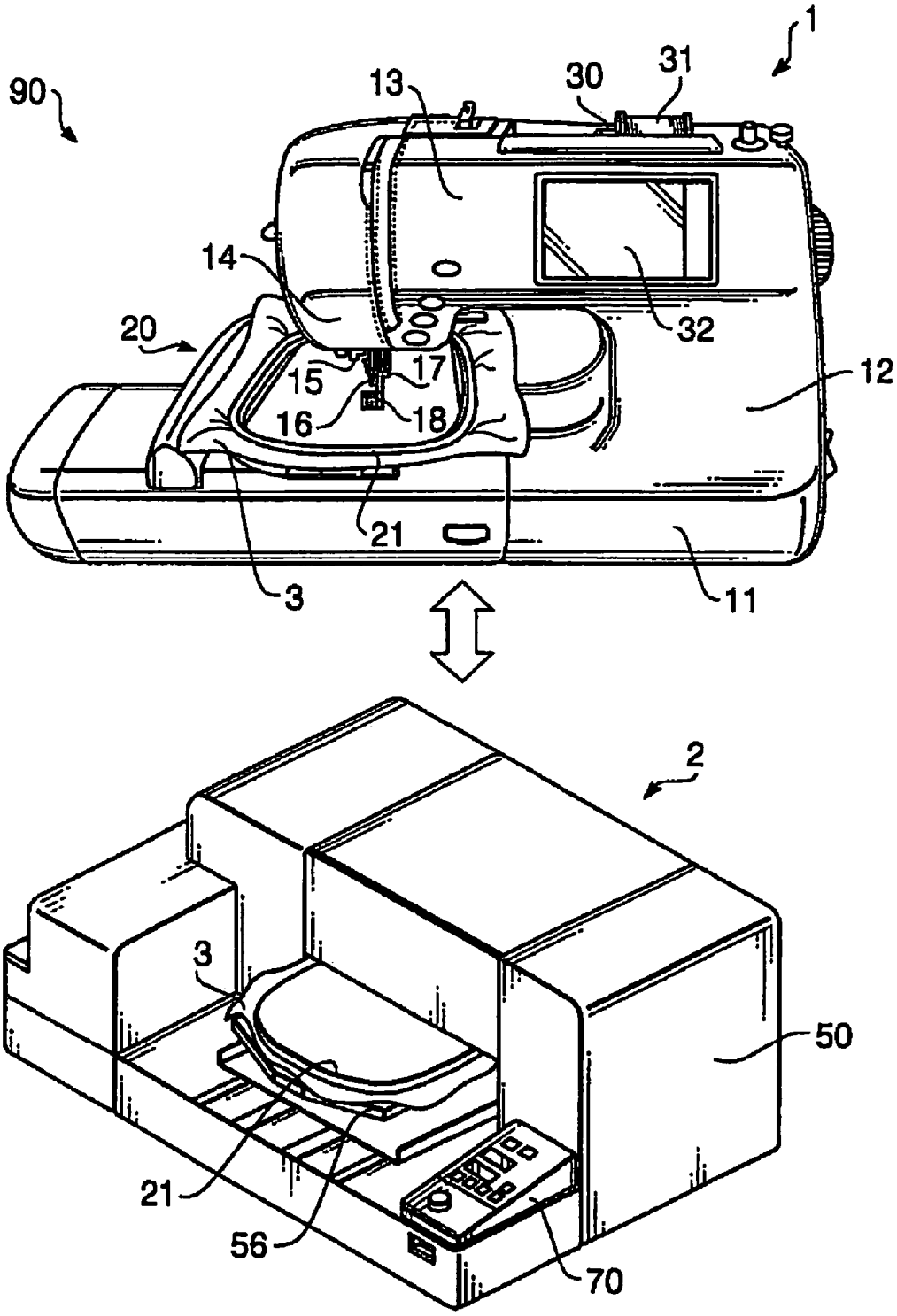
FIG. 1 shows an embroidering and printing system according to an embodiment of the invention.

FIG. 1 shows an embroidering and printing system 90 according to an embodiment of the invention. The embroidering and printing system 90 includes a sewing machine 1 having an embroidering function, and an inkjet printing device 2 configured to print images (designs or patterns) on fabric 3 such as a T-shirt.

One of examples of processes performed in the system 90 is as follows. Firstly, the sewing machine 1 embroiders an embroidery pattern on the fabric 3 in accordance with embroidery data which has been inputted to the sewing machine 1 from, for example, an external computer. Then, the fabric 3 is loaded onto a platen 56 of the inkjet printing device 2 so as to perform a printing operation on the fabric 3.

Alternative to such a process, the printing operation on the fabric 3 may be performed first by the inkjet printing device 2 before the embroidering operation for embroidering the embroidery pattern on or in the vicinity of the image printed on the fabric 3 by the inkjet printing device 2.

As shown in FIG. 1, the sewing machine 1 includes a bed portion 11, a pillar 12, an arm portion 13, and a head unit 14. In the head unit 14, a needle bar 15 and a presser bar 17 are supported to be movable in the vertical direction. A sewing needle 16 is attached to a lower end of the needle bar 15. A presser foot 18 used to press the fabric 3 for the embroidery is attached to the lower end of the presser bar 17.

In the upper position of the arm portion 13, a bobbin 30 having upper thread 31 is located. The upper thread 31 is pulled out of the bobbin 30 and is inserted into a needle hole of the sewing needle 16 via an upper thread take-up mechanism provided in the arm portion 13. A loop taker (not shown) is provided in the bed portion 11. The loop taker has a rotating hook and is used to hold a lower thread. The sewing needle 16 is moved upwardly and downwardly in association with the loop taker so that the upper thread and the lower thread cross with respect to each other to form seams.

On the front side of the arm portion 13, an LCD (liquid crystal display) panel 32 is located. On the LCD panel 32, various types of menus including a replacement time of the thread, settings of sewing methods, and settings of tension of the thread are displayed so as to allow an operator to select a desirable menu.

The sewing machine 1 has an automatic tension control unit implemented by a microcomputer chip (not shown). The automatic tension control unit detects the thickness of the fabric 3 to adjust the tension of the upper thread and the lower thread considering the sewing method selected by the operator through use of the LCD panel 32.

The sewing machine 1 is provided with a driving motor, a needle bar driving mechanism for driving the needle bar 15, a thread take-up, a thread take-up driving mechanism for driving the thread take-up, a rotating hook driving mechanism for driving the rotating hook. These driving mechanisms operate to transmit a driving force of the driving motor to the needle bar 15, the thread take-up and the rotating hook.

An embroidery frame moving mechanism 20 including an embroidery frame 21 is detachably attached to the bed portion 11. The embroidery frame 21 holds the fabric 3. The embroidery frame moving mechanism 20 is used to locate the embroidery frame 21 at a desired position represented by X and Y coordinates defined by the sewing machine 1. When the embroidery frame 21 is situated at a predetermined position, the sewing operation by the sewing needle 16 and the rotating hook giving mechanism is performed to form designs on the fabric 3.

The embroidery frame moving mechanism 20, the needle bar 15 and the sewing needle 16 are controlled by the microcomputer chip to automatically perform the embroidering operation by using sewing data (stitch data) which designates a moving amount of the fabric 3 (i.e. a needle dropping position) for each stitch. The sewing machine 1 further includes an EEPROM (electrically erasable programmable ROM) which stores the sewing data inputted to the sewing machine 1, for example, from the eternal computer.

Figure 2:
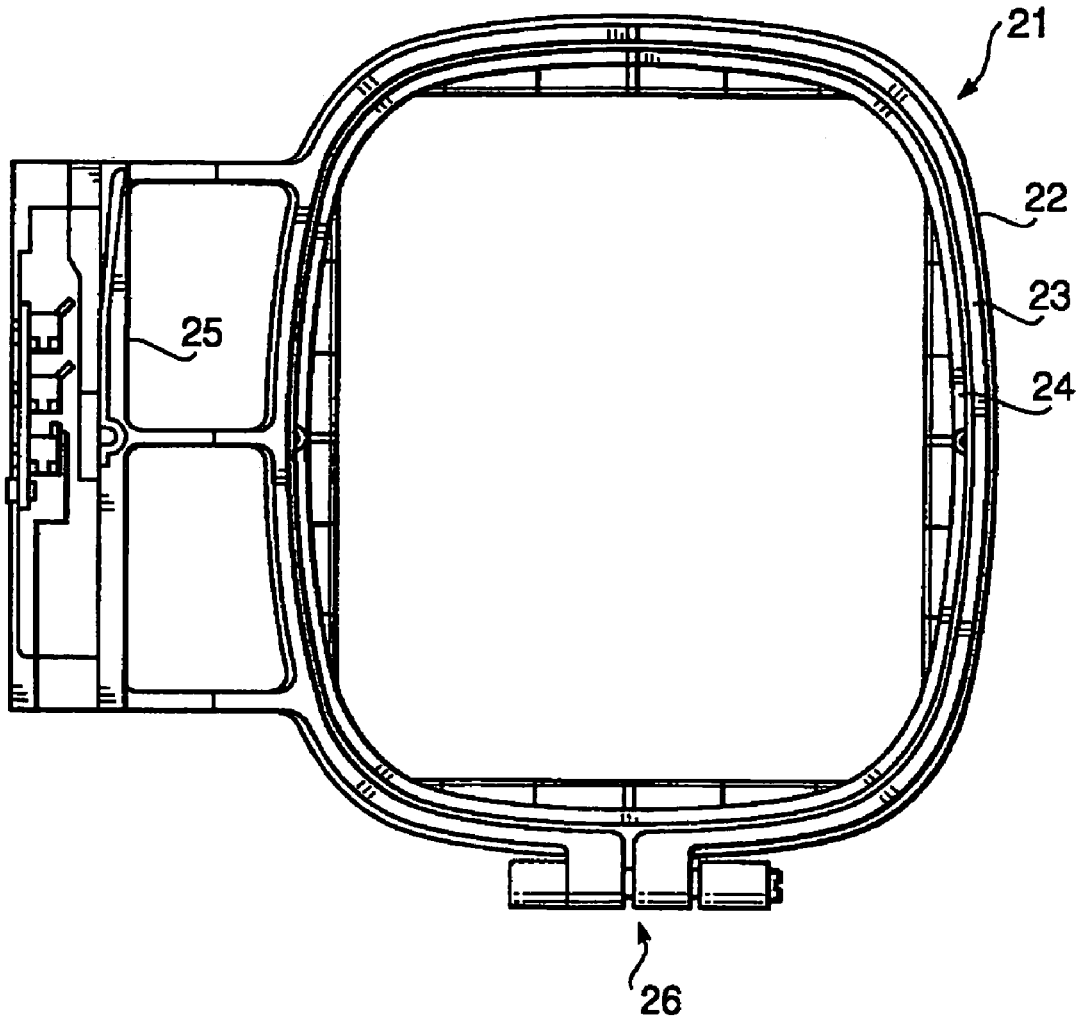
FIG. 2 is a plan view of an embroidery frame.

Next, a configuration of the embroidery frame 21 will be explained with reference to FIG. 2. FIG. 2 is a plan view of the embroidery frame 21. As shown in FIG. 2, the embroidery frame 21 includes a fame part 22 for holding the fabric 3, and a connection part 25 used to connect the embroidery frame 21 to the embroidery frame moving mechanism 20 using, for example, a screw.

Typically, the connection part 25 is connected to the embroidery frame moving mechanism 20 so that the fabric 3 attached to the embroidery frame 21 is situated at a bottom side (i.e. a side farther from the sewing needle 16). In this case, embroidery patterns can be formed by the upper thread 31. The frame part 22 has an outer frame 23, an inner frame 24 and a clamping mechanism 26. The fabric 3 is pinched between the outer frame 23 and the inner frame 24 by clamping the inner frame 24 by the outer frame 23 using the clamping mechanism 26.

Figure 3:
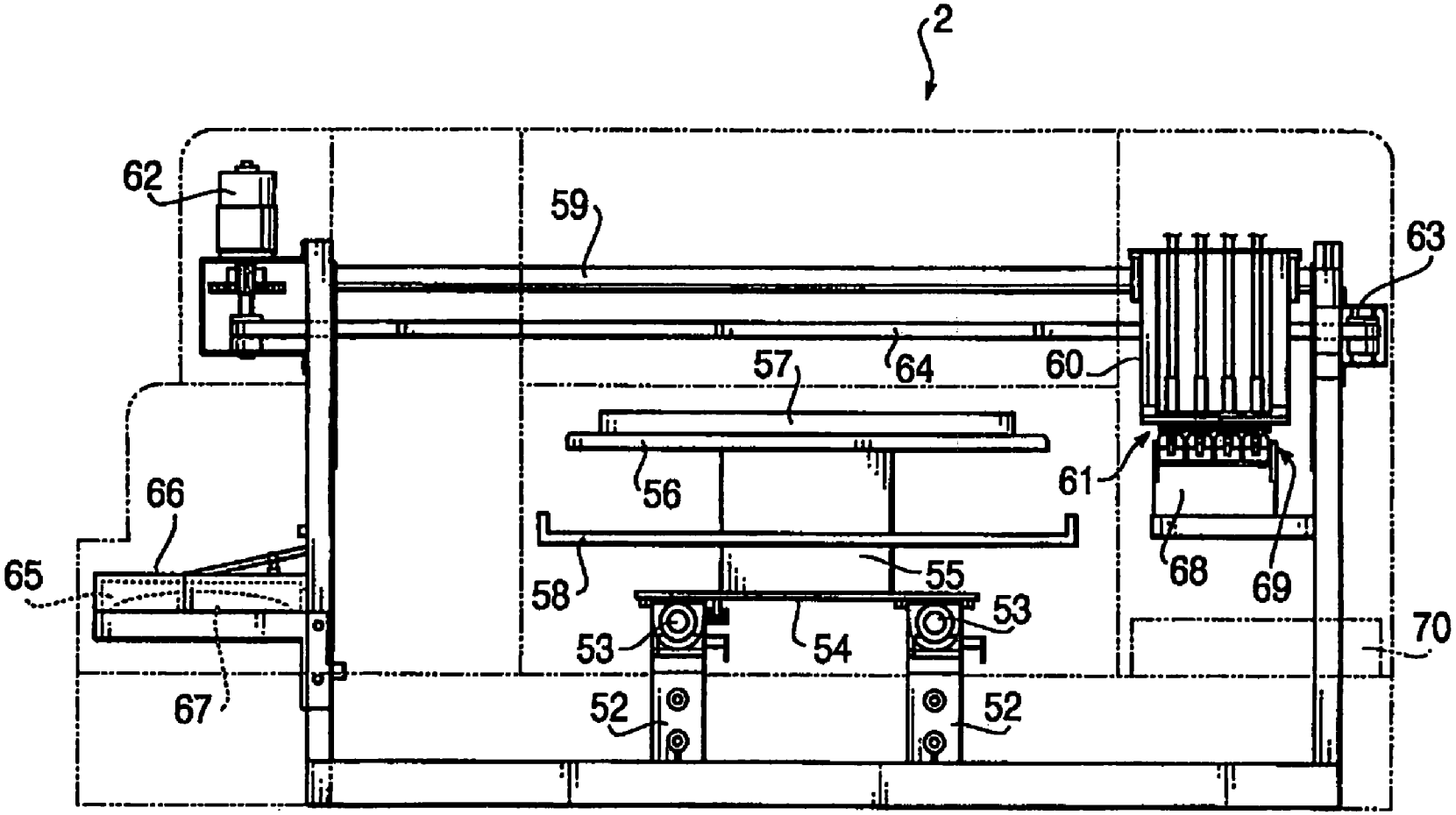
FIG. 3 is a front view of an inkjet printing device.

Next, the configuration of the inkjet printing device 2 will be explained with reference to FIGS. 1 and 3. FIG. 3 is a front view of the inkjet printing device 2. As shown in FIGS. 1 and 3, two guide rails 53 are located at positions corresponding to the center of a bottom surface of a housing 50 so as to be elongated in the back-and-forth direction. The guide rails 53 are respectively supported on the tops of bases 52 which are formed to protrude from the bottom surface of the housing 50 in the vertical direction.

A platen support base 54 is supported by the guide rails 53 to be movable along the guide rails 53 in the back-and-forth direction. A support column 55 is formed to protrude in the vertical direction from the top surface of the platen support base 54. The platen 56 is detachably attached to the top end of the support column 55. That is, one of a plurality of types of platens can be selected and can be attached to the support column 55.

The platen 56 is a plate-like member having a rectangular form when it is viewed as a plan view. The fabric 3 (e.g. a T-shirt) is loaded onto the platen 56 so that the T-shirt is horizontally held on the platen 56 (see FIG. 1). A projected part 57 is formed on the top surface of the platen 56. The projected part 57 has a size which enables the projected part 57 to be fitted into the inner frame 24 of the embroidery frame 21, and has a height which is substantially the same as that of the inner frame 24.

The plurality of types of platens 56 provided with projected parts 57 having different shapes corresponding to the shapes of the inner frames 24 of different types may be prepared and used for the printing operation. In this case, the operator can select one of the platens 56 matching with the type of the embroidery frame 21 to be used. Another type of the platen 56 configured to fit into the outer frame 23 may be prepared and used for the printing operation.

A tray 58 is located at the center of the support column 55 between the platen 56 and the platen support base 54. The tray 58 has a bottom surface which is substantially parallel with a top surface of the platen 56 and has a size lager than that of the platen 56. The tray 58 catches, for example, sleeves of the T-shirt (the fabric 3) so as to keep the sleeves from falling to the bottom surface of the housing 50 during loading work for loading the T-shirt onto the platen 56.

At the rear side of the guide rail 53, a platen motor 73 (see FIG. 4) is located for driving the platen support base 54 in the back-and-forth direction. A driving belt (not shown) is hooked to a driving shaft of the platen motor 73 and to a pulley (not shown) attached to a front end of the guide rail 53 so that the platen support base 54 fixed to the driving belt is driven to reciprocate in the back-and-forth direction along the guide rails 53.

Above the platen 56, a guide rail 59 is located at a position corresponding to the center of the housing 50 in the back-and-forth direction. The guide rail 59 is elongated to cross the upper portion of the housing 50 from the left side to the right side of the housing 50 so as to guide a carriage 60 in the left and right direction. At the left end portion (in FIG. 3) of the guide rail 59, a carriage motor 62 is provided. A pulley 63 is provided at the right end portion (in FIG. 3) of the guide rail 59. A carriage belt 64 is hooked to the carriage motor 62 and the pulley 62. The carriage 60 is fixed to the carriage belt 64.

By this structure, the carriage 60 is driven to reciprocate along the guide rail 59 in the left and right direction of the housing 50 by the driving force of the carriage motor 62. The carriage motor is, for example, a DC motor. The position of the carriage 60 is detected based on output signals of a linear encoder (not shown) provided on the guide rail 59.

The carriage 60 has a box shape and is provided with four piezoelectric type inkjet heads 61 at its bottom surface (i.e. a nozzle surface). The four inkjet heads 61 eject four types of ink respectively corresponding to color components of cyan, magenta, yellow and black. Each inkjet head 61 has a plurality of channels (e.g. 128 channels) for ejecting ink. Each channel has a piezoelectric actuator (not shown) and a nozzle formed in the bottom portion of the inkjet head 61. In this structure, the inlet head 61 is controlled so that drops of ink are ejected downwardly from the nozzle surface of the inkjet head 61.

At the left side wall of the housing 50, an ink housing 66 which accommodates four ink carriages 65 respectively corresponding to the four color components is located. The ink cartridges 65 are detachably attached to the ink housing 66. The ink cartridges 65 are aligned in a line in the back-and-forth direction.

Each ink cartridge 65 accommodates an ink pack 67. The ink packs are connected to the inkjet heads 61, respectively, by tubes so that the ink is supplied from the ink pack 67 to the channels of the inkjet head 61.

At a right end position of a moving path of the carriage 60, a maintenance unit 68 is located. The maintenance unit 68 includes suction caps 69 which closely contact the inkjet heads 61, respectively, to suck ink remaining on the nozzle surfaces of the inkjet heads 61. Since the suction cap 69 covers the nozzle surface while the printing operation is not performed, the ink (i.e. the nozzle surface) is prevented from drying.

On the front side of the housing 50, an operation panel 70 is provided at the right end portion of the inkjet printing device 2. The operation panel 70 is used by the operator to input various types of commands to the inkjet printing device 2. The operation panel 70 includes a LCD panel on which various types of instruction menus are displayed, and a plurality of type of buttons (including a purge button).

Figure 4:
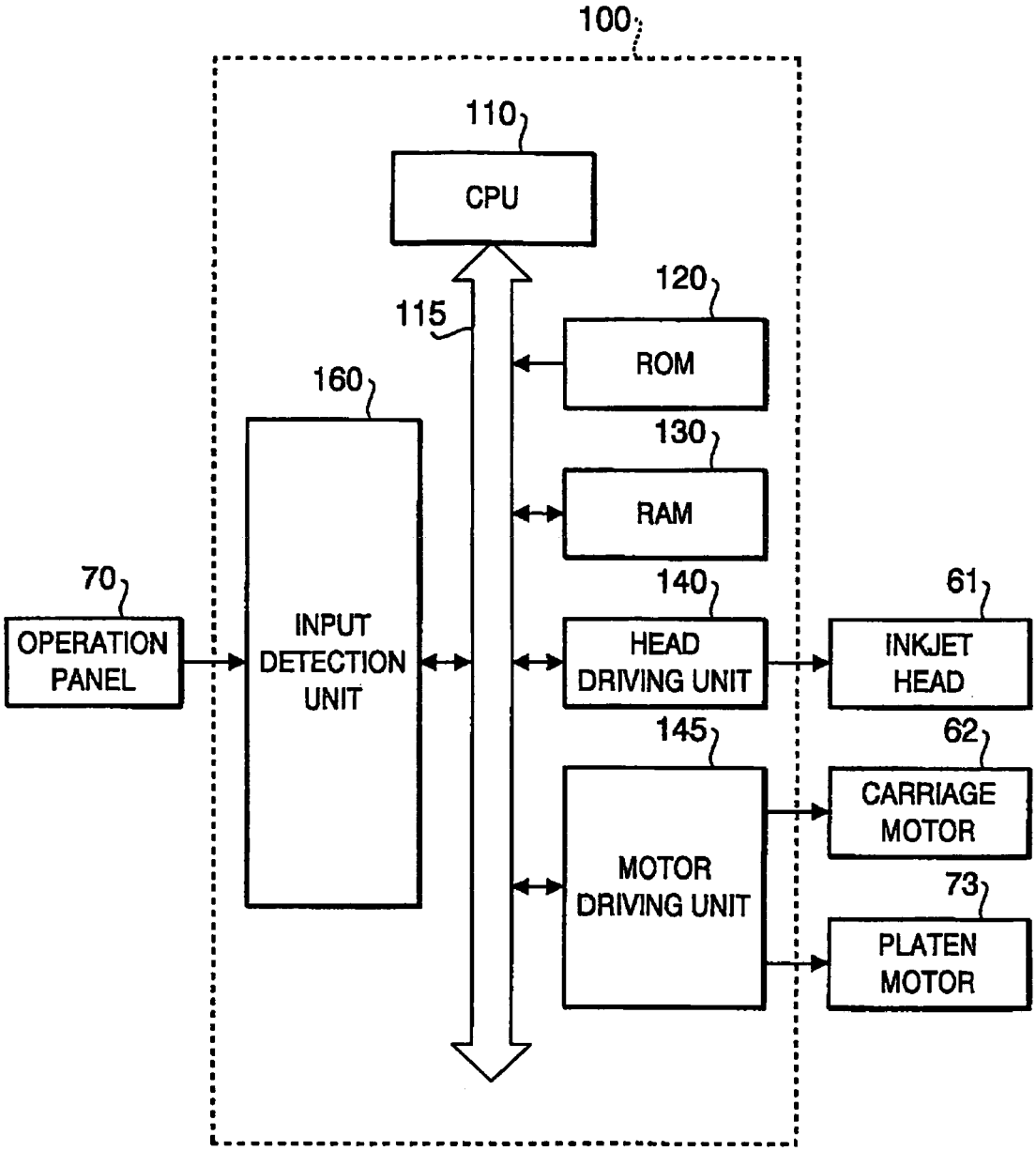
FIG. 4 is a block diagram of a control unit of the inkjet printing device.

Next, a control system of the inkjet printing device 2 will be explained with reference to FIG. 4. FIG. 4 is a block diagram of a control unit 100 of the inkjet printing device 2. As shown in FIG. 4, the control unit 100 includes a CPU (central processing unit) 110 for controlling the entire inkjet printing device 2. The control unit 100 further includes a ROM (read only memory) 120 which stores various types of programs to be executed by the CPU 110, a RAM (random access memory) 130 for temporarily storing data, which are connected to the CPU 110 via a bus 115.

A head driving unit 140 and a motor driving unit 145 are also connected to the CPU 110 via the bus 115. The head driving unit 140 operates to drive the piezoelectric actuator provided in each channel. The motor driving unit 145 operates to drive the carriage motor 62 and the platen motor 73. An input detection unit 160 is also connected to the CPU 110 via the bus 115. The input detection unit 160 is connected to the operation panel 70 to detect input signals from the operation panel 70 including the buttons.

Next, the embroidering and printing operation performed by the system 90 will be explained. Firstly, the fabric 3 (e.g. a T-shirt) to be subjected to the embroidering and printing operation is loaded onto the embroidery frame 21. More specifically, the fabric 3 is pinched between the outer frame 23 and inner frame 24 by using the clamping mechanism 26. The fabric 3 is loaded onto the embroidery frame 21 such that a surface of the fabric 3 on which the embroidery patterns are to be formed is situated on a lower thread side. Such a loading manner of the fabric 3 onto the embroidery frame 21 is opposite in direction to a typical case.

Figure 5:
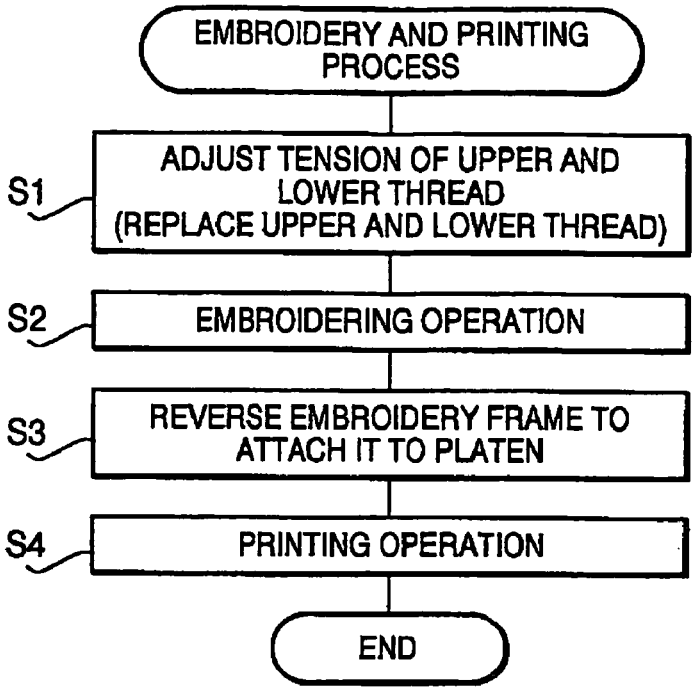
FIG. 5 is a flowchart illustrating an embroidering and printing operation in which an embroidery operation is performed before a printing operation.

If the embroidery operation is performed before the printing operation, the operation is performed as follows. FIG. 5 is a flowchart illustrating the operation in which the embroidery operation is performed before the printing operation. The embroidery frame 21 on which the fabric 3 is loaded is attached to the embroidery frame moving mechanism 20. Then, the user selects a thread tension control menu on the LCD panel 32 to reverse the tension settings of the upper thread 31 and the lower thread (step S1).

In a typical case in which the embroidery patterns are formed by the upper thread 31, the tension is adjusted such that the tension of the lower thread is stronger than that of the upper thread 31. By contrast in this embodiment, the tension is adjusted such that the tension of the upper thread 31 is stronger than that of the lower thread.

Next, the user operas the sewing machine 1 to start the embroidery operation (step S2). Since the tension of the upper thread 31 is stronger than that of the lower thread, the embroidery patterns are formed on a bottom surface (a lower thread side surface) of the fabric 3 contacting the bed portion 11. If the materials of the upper and lower thread are different from each other, the operator is required to replace the upper thread and the lower thread (see step S1). It should be noted that since the bottom surface of the fabric 3 is used as an embroidering surface in this embodiment (i.e. the embroidery patterns are formed on the bottom surface of the fabric 3), reversed embroidery data is used for the embroidering operation. That is, if embroidery data used in the typical case is defined as normal embroidery data, data (i.e. the reversed embroidery data) made by reversing the normal embroidery data is used for the embroidery operation in this embodiment.

After the embroidering operation is finished, the embroidery frame 21 is detached from the embroidery frame moving mechanism 20, with the fabric 3 being loaded on the embroidery frame 21. Then, the embroidery frame 21 is attached to (fitted into) the projected part 57 of the platen 56. In this stag, the embroidery frame 21 is reversed so that the inner surface of the inner frame 24 contacts the side surface of the projected part 57, by which the surface of the fabric 3 on which the embroidery patterns are formed faces the inkjet head 61 (step S3).

When the inkjet printing device 2 is turned ON, a control program is read by the CPU 110 from the ROM 120 to perform initialization. When transmission of print data from an external device is started, the print data is loaded into a print data storing area of the RAM 130. After the transmission of the print data is finished, an operator checks whether the fabric 3 is properly loaded onto the platen 56. If the fabric 3 is properly loaded onto the platen 56, the operator presses a print start button provided in the operation panel 70 so as to start the printing operation.

When the printing operation is started, the platen motor 73 is driven to move the platen 56 to a print start position situated at the rear portion of the housing 50. Then, the platen 56 is moved to a print end position situated at the front portion of the housing 50 at a constant speed. While the platen 56 is moved from the print start position to the print end position, the carriage 60 reciprocates in the left and right direction which is perpendicular to the moving direction of the platen 56 and operates to eject ink on the fabric 3. By this configuration, an image (design or pattern) are printed on the fabric 3 (step S4). Thus, the printing operation is completed.

It is preferable that the print data and the embroidery data are based on coordinates of the embroidery frame 21. For example, the embroidery data may be configured to designate embroidering positions with respect to a center of the embroidery frame 21 and the print data may also be configured to designate printing positions with respect to the center of the embroidery frame 21.

Since as described above the sewing machine 1 is configured to be capable of adjusting the position of the embroidery frame 21 and the inkjet printing device 2 is also configured to be capable of adjusting the position of the embroidery frame 21, the sewing positions on the fabric 3 with respect to the embroidery frame 21 can be designated for the embroidery operation of the sewing machine 1 and the printing positions on the fabric 3 with respect to the embroidery frame 21 can be designated for the printing operation of the inkjet printing device 2. Thus, the positioning of the fabric 3 (the embroidery frame 21) for both of the printing operation and the embroidering operation is attained.

Figure 6:
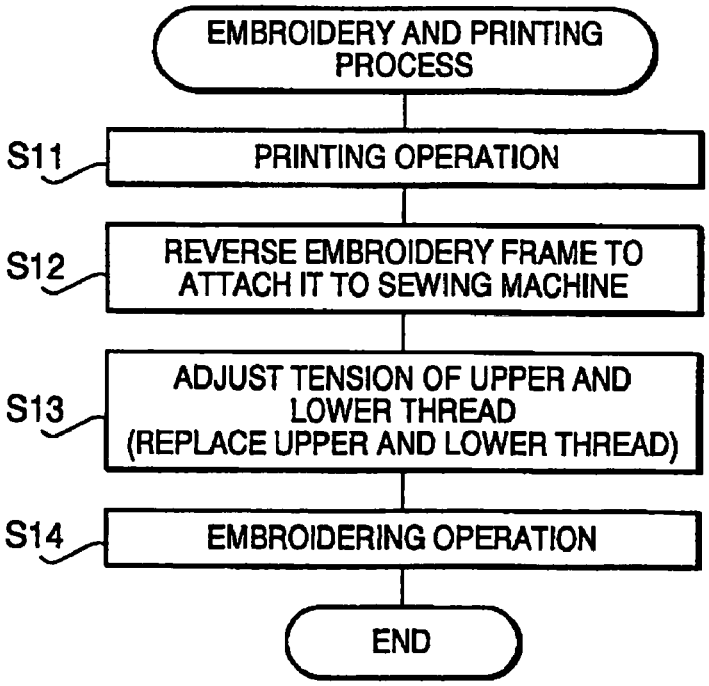
FIG. 6 is a flowchart illustrating the embroidering and printing operation in which the printing operation is performed before the embroidering operation.

If the printing operation is performed before the embroidering operation, the embroidering and printing operation is performed as follows. FIG. 6 is a flowchart illustrating the operation in which the printing operation is performed before the embroidering operation. Firstly, the fabric 3 is attached to the embroidery frame 21 as mentioned above. Then, the embroidery frame 21 is fitted to the projected part 57 of the platen 56. After the print data is received by the inkjet printing device 2, the printing operation is started (step S11).

After the printing operation is finished, the embroidery frame 21 is detached from the platen 56. Then, the operator reverses the embroidery frame 21 and attaches the embroidery frame 21 to the embroidery frame moving mechanism 20 so that the surface of the fabric 3 on which the image is printed faces the bed portion 11 (step S12).

Next, the operator selects one of the menus on the LCD panel 32 to reverses the settings of the tension of the upper thread 31 and the lower thread (step S13). That is, the tension is adjusted such that the tension of the upper thread 31 becomes stronger than that of the lower thread. Then, the embroidery data is inputted to the sewing machine 1 to start the embroidering operation (step S14). As mentioned with reference to FIG. 5, the embroidery data made by reversing the normal embroidery data is used for the embroidering operation (in step S14). More specifically, the embroidery data used in this embodiment is formed by reversing the print data (i.e. the embroidery data is formed by use of coordinates having reversed relationship with respect to coordinates of the print data).

Sine the tension of the upper thread 31 is stronger than that of the lower thread, the embroidery pattern is formed on the surface of the fabric facing the bed portion 11 by the lower thread. If the materials of the upper and lower thread are different from each other, the operator is required to replace the upper thread and the lower thread (see step S13).

As described above, according to the embodiment, positioning of the fabric for both of the printing operation and the embroidering operation is attained by use of the embroidery frame 21 without difficulty. It should be noted that such positioning can be attained in the case where an image (design or pattern) is printed by the inkjet printing device 1 on a printing surface on which embroidery has been already formed or in the case where an embroidery pattern is formed by the sewing machine 1 on a surface on which an image (design or pattern) has been already printed.

As described above, the embroidery frame 21 is attached to the sewing machine 1 such that the fabric 3 contacts the bed portion 11, and the tension of the upper thread 31 and the lower thread are replaced with respect to each other. Therefore, the embroidery pattern is formed on the surface of the fabric facing the bed portion 11 (i.e. the lower thread side surface of the fabric 3). Meanwhile, the embroidery fame 21 is inversed and is attached to the inkjet printing device 2 such that the embroidery frame 21 is fitted to the projected part 57 of the platen 56.

That is, the embroidery frame 21 is fitted to the project part 57 of the platen 56, with a side surface thereof at which the fabric 3 is stretched facing the inkjet head 61. The printing operation is performed on the surface on which the embroidery pattern has been formed.

Also, it is prevented that the distance between the inkjet head 61 and the printing surface is lengthened by the height of the embroidery frame 21. Consequently, high printing quality is maintained. That is, according to the embodiment, the distance between the inkjet head 61 and the printing surface is kept at a small value, by which the high printing quality is maintained.

What is claimed is:

1. An inkjet printing device for performing a printing operation on fabric by use of an embroidery frame which is also used by a sewing machine to form an embroidery pattern on fabric, comprising:

an inkjet head that ejects ink on a surface of the fabric;

a holding member configured to fit in the embroidery frame to hold the embroidery frame, the embroidery frame holding the fabric in a state of tension; and a print control unit configured to perform the printing operation on the surface of the fabric held by the embroidery frame by use of the inkjet head and the holding member;

wherein the embroidery frame is fitted to the holding member so that the surface of the fabric to be printed faces the inkjet head, wherein when the holding member holds the embroidery frame, the embroidery frame has a first orientation and when the sewing machine holds the embroidery frame, the embroidery frame has a second orientation, the first orientation being reversed from the second orientation.

2. The inkjet printing device according to claim 1, wherein the embroidery frame includes an inner frame and an outer frame surrounding the inner frame, the fabric being stretched by being pinched between the inner frame and the outer frame.

3. The inkjet printing device according to claim 1, wherein the holding member includes a platen having a projected part to which the embroidery frame is fitted.

4. The inkjet printing device according to claim 1, wherein print data used to perform the printing operation on the fabric is based on coordinates of the embroidery frame.

5. An embroidering and printing system, comprising:

a sewing machine having an embroidery frame that holds the fabric in a state of tension, the embroidery frame being configured to be detachably attached to the sewing machine; and an inkjet printing device having an inkjet head for ejecting ink on a surface the fabric, wherein the inkjet printing device includes:

a holding member configured to fit in the embroidery frame to hold the embroidery frame; and a print control unit configured to perform a printing operation on the surface of the fabric by driving the inkjet head, wherein the embroidery frame is fitted to the holding member so that the surface of the fabric to be printed faces the inkjet head, wherein when the holding member holds the embroidery frame, the embroidery frame has a first orientation and when the sewing machine holds the embroidery frame, the embroidery frame has a second orientation, the first orientation being reversed from the second orientation.

6. The embroidering and printing system according to claim 5, wherein the embroidery frame includes an inner frame and an outer frame surrounding the inner frame, the fabric being stretched by being pinched between the inner frame and the outer frame.

7. The embroidering and printing system according to claim 5, wherein the holding member of the inkjet printing device includes a platen having a projected part to which the embroidery frame is fitted.

8. The embroidering and printing system according to claim 5, wherein the sewing machine includes a tension adjustment unit that adjusts tension of an upper thread and a lower thread, and wherein the tension adjustment unit operates so that the tension of the upper thread is stronger than that of the lower thread.

9. The embroidering and printing system according to claim 5, wherein print data used to perform the printing operation on the fabric by the inkjet printing device and embroidery data used to perform an embroidery operation by the sewing machine are based on coordinates of the embroidery frame.

10. A method of embroidering and printing on fabric, comprising:

embroidering an embroidery pattern on the fabric which is held by an embroidery frame in a state of tension by a sewing machine;

removing the embroidery frame from the sewing machine to attach the embroidery frame to an inkjet printing device;

attaching the embroidery frame to the inkjet printing device so that a surface of the fabric to be printed faces the inkjet head, and printing on the surface of the fabric held by the embroidery frame attached to the inkjet printing device, wherein when the embroidery frame is attached to the inkjet printing device, the embroidery frame has a first orientation, and when the embroidery frame is attached to the sewing machine, the embroidery frame has a second orientation, the first orientation being reversed the second orientation.

11. The method according to claim 10, further comprising:

adjusting tension of an upper thread and a lower thread, before embroidering the embroidery pattern on the fabric, such that the tension of the upper thread is stronger than that of the lower thread.

12. The method according to claim 11, further comprising:

replacing the upper thread and the lower thread with each other before embroidering the embroidery pattern on the fabric.

13. A method of embroidering and printing on fabric, comprising:

printing on a surface of the fabric which is held by an embroidery frame in a state of tension by an inkjet printing device;

removing the embroidery frame holding the fabric from the inkjet printing device to attach the embroidery frame to a sewing machine, the sewing machine having a sewing needle;

attaching the embroidery frame to the sewing machine so that the printed surface of the fabric faces away from the sewing needle of the sewing machine; and embroidering an embroidery pattern on the fabric held by the embroidery frame attached to the sewing machine, wherein when the embroidery frame is attached to the inkjet printing device, the embroidery frame has a first orientation, and when the embroidery frame is attached to the sewing machine, the embroidery frame has a second orientation, the first orientation being reversed the second orientation.

14. The method according to claim 13, further comprising:

adjusting tension of an upper thread and a lower thread, before embroidering the embroidery pattern on the fabric, such that the tension of the upper thread is stronger than that of the lower thread.

15. The method according to claim 14, further comprising:

replacing the upper thread and the lower thread with each other before embroidering the embroidery pattern on the fabric.

* * * * *